United States Patent [19]

Coleman

[11] 4,053,095

[45] Oct. 11, 1977

[54] SUPPORT FOR ATTACHING HEELS TO SHOES

[75] Inventor: Trevor Norman Coleman, Oadby, England

[73] Assignee: USM Corporation, Boston, Mass.

[21] Appl. No.: 682,639

[22] Filed: May 3, 1976

[30] Foreign Application Priority Data

Jan. 21, 1976 United Kingdom ..... 2279/76

[51] Int. Cl.[2] ..... B27F 7/00

[52] U.S. Cl. ..... 227/135

[58] Field of Search ..... 227/30, 78, 135

[56] References Cited

U.S. PATENT DOCUMENTS

| | | | |
|---|---|---|---|
| 592,615 | 10/1897 | Quickert et al. | 227/78 |
| 2,330,316 | 9/1943 | Standish | 227/135 |
| 3,148,374 | 9/1964 | Bassford et al. | 227/135 |

*Primary Examiner*—Granville Y. Custer, Jr.

*Attorney, Agent, or Firm*—Carl E. Johnson; Richard B. Megley; Vincent A. White

[57] ABSTRACT

A heel attaching machine is provided with a shoe support particularly well suited for attaching stilletto-type heels by means of a plurality of nails and a staple driven into the rear portion of a heel seat and inclined toward the center of the heel.

1 Claim, 2 Drawing Figures

Fig. 1
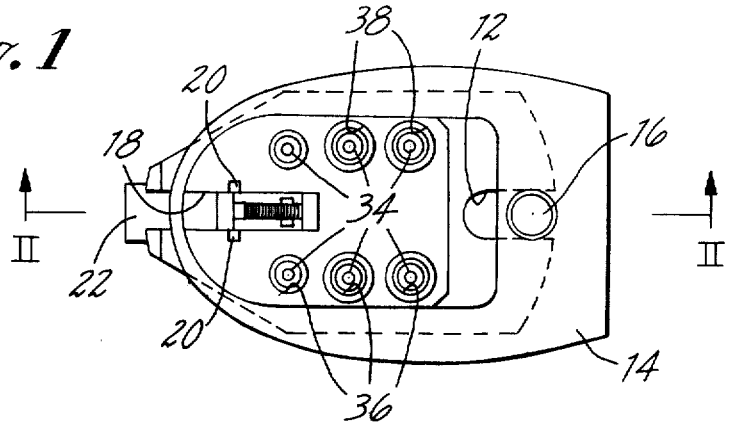
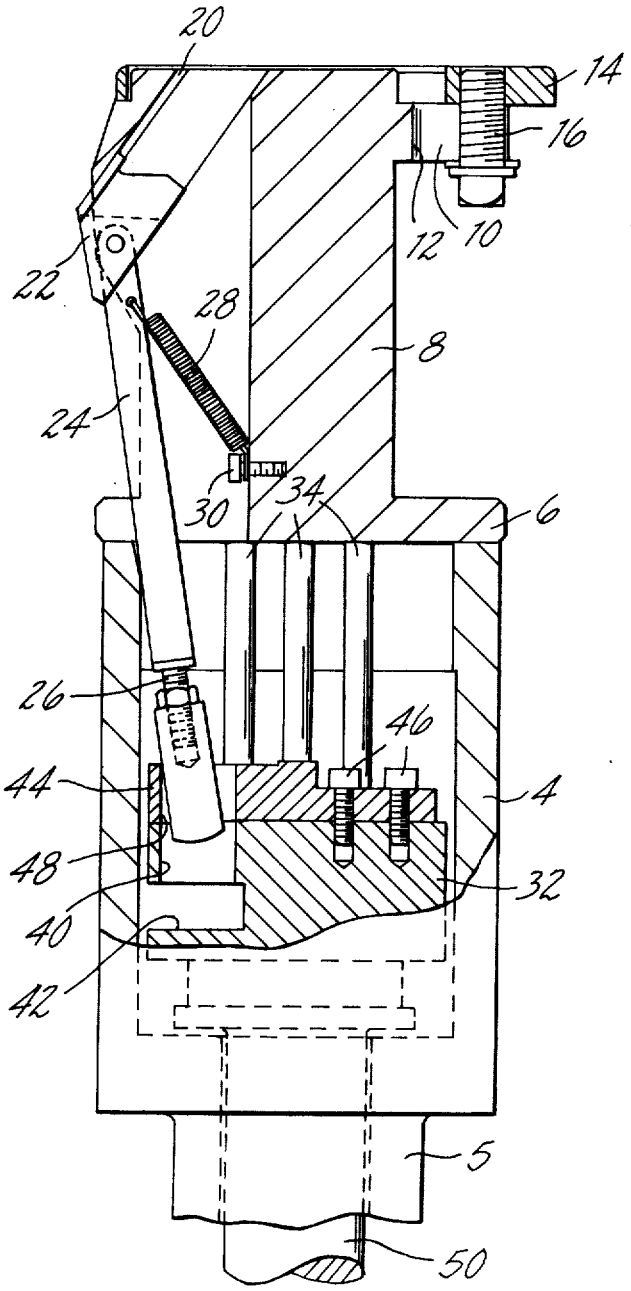
Fig. 2

SUPPORT FOR ATTACHING HEELS TO SHOES

BACKGROUND OF THE INVENTION

This invention is concerned with improvements in or relating to the manufacture of shoes and is especially concerned with attachment of heels to shoes.

The term "shoe" where used herein is to be understood as referring to outer footwear generally whether in a completed state or in the course of manufacture.

In attaching heels to shoes, difficulties have been encountered with heels which taper sharply from the part of the heel which engages the heel seat of a shoe to a slender stem, such heels being referred to as being of "stiletto" type. These difficulties have arisen from there being insufficient material in the rearward portion of the heel to receive heel attaching nails. Hence, where such a heel is nailed onto a shoe a gap may develop between the rearward portion of the heel which has no nails therein and the insole to which the heel is attached.

One solution to the problem of providing attachment of the rearward portion of a heel of the stiletto type is described in U.S. Pat. No. 3,148,347. In that specification, a machine is described by which a plurality of staples is driven into a heel seat of a shoe and the heel thereof to attach the shoe, the rearmost staple being driven in at an inclination such that its legs are inclined forwardly towards a central region of the heel. This machine provides attachment for the rearward portion of the heel by the rearmost staple which can be received therein by reason of its inclination; however shoe manufacturers customarily prefer to use nails rather than staples for heel attaching as they believe that nails give stronger attachment. For this reason it is desirable to enable nails to be used for attaching stiletto type heels.

SUMMARY OF THE INVENTION

It is one of the various objects of the present invention to provide an improved shoe support, suitable for use in a machine for attaching heels to shoes, which support enables a heel of the stiletto type to be attached in a single operation by means of nails over central and forward portions thereof and by means of a staple at the rearward portion thereof.

There is hereinafter described in detail with reference to the accompanying drawings a shoe support which illustrates the invention by way of example. The illustrative shoe support is suitable for use in a machine for attaching heels to shoes and a hollow cylindrical support column thereof may be fixedly mounted in such a machine. The support column has secured thereon a driver guide block of the illustrative support which provides supporting means for a gauging means whereby the heel seat of a shoe can be located on the support for a heel to be attached thereto.

The driver guide block of the illustrative support preferably has six bores therethrough which form nail guides in each of which a nail can be located to be driven into a heel seat and heel of a shoe over central and forward portions of the heel. The driver guide block also has two oppositely facing slots therein which together form an inclined staple guide positioned rearwardly of the nail guides, and in which a staple can be located to be driven into the heel seat and heel of a shoe at the rearward portion of the heel thereof. The inclination of the staple guide is such that a staple driven therefrom enters the heel seat and heel with its legs inclined towards a central region of the heel.

The illustrative support also comprises a driving member positioned within the support column and which, together with cylindrical nail drivers of the support which extend into the nail guides and a staple driving head which is slidable in the staple guide, forms driving means arranged to drive nails and a staple located in the guides as aforesaid into a heel seat of a shoe and the heel thereof to attach the heel to the shoe. The driving member is usually arranged to be connected to power means in the form of a hydraulic cylinder of the heel attaching machine. Operation of the hydraulic cylinder causes the driving member to move in the support column thereby simultaneously moving the nail drivers and staple driving head in their guides to drive the nails and staple.

The invention provides, in one of its several aspects, a shoe support suitable for use in a machine for attaching heels to shoes, the support comprising a plurality of nail guides in each of which a nail can be located to be driven into the heel seat and heel of a shoe, a staple guide in which a staple can be located to be driven into the heel seat and heel of the shoe, and driving means arranged to drive the nails and the staple located in the guides as aforesaid into the heel seat of the shoe and the heel thereof to attach the heel to the shoe.

The invention provides, in another of its several aspects, a shoe support suitable for use in a machine for attaching heels to shoes, the support comprising supporting means for gauging means by which the heel seat of a shoe can be located on the support for a heel to be attached thereto, a plurality of nail guides in each of which a nail can be located to be driven into a heel seat and heel of a shoe, an inclined staple guide positioned rearwardly of the nail guides in which a staple can be located to be driven into the heel seat and heel of a shoe so that the staple enters the heel seat and heel with its legs inclined towards a central region of the heel, and driving means arranged to drive nails and a staple located in the guides as aforesaid into a heel seat of a shoe and the heel thereof to attach the heel to the shoe.

The invention also provides, in another of its several aspects, a heel attaching machine comprising a shoe support as set out in either of the last two preceding paraprahs and power means arranged to cause said driving means to drive nails and a staple as aforesaid.

BRIEF DESCRIPTION OF THE DRAWINGS

The above and other of the various objects and several aspects of the invention will become more clear from the following detailed description, to be read with reference to the accompanying drawings, of the illustrative shoe support aforementioned. It is to be understood that the illustrative shoe support has been selected for description by way of example only and not by way of limitation of the invention.

In the accompanying drawings:

FIG. 1 is a plan view of the illustrative shoe support; and

FIG. 2 is a sectional view taken on the line II—II in FIG. 1.

DESCRIPTION OF THE PREFERRED EMBODIMENTS

The illustrative shoe support comprises a hollow cylindrical support column 4 (FIG. 2) which has a portion 5 of reduced diameter suitable for location in a machine for attaching heels to shoes. The column 4 can be fixedly mounted in such a machine. A cylindrical lower flange 6 of a driver guide block 8 rests on top of the column 4 and is secured thereto.

The upper end portion of the driver guide block 8 has a gauge 14 mounted thereon, the gauge 14 being secured to the block 8 by means of a screw 16 which is received in a slot 12 in a forward projection 10 of the block 8. The gauge 14 is in the shape (in plan view) of the heel seat of a shoe. The gauge 14 provides gauging means by which the heel seat can be located on the support for a heel to be attached thereto. The heel seat is located by being fitted over and around the gauge 14. So that the illustrative support can accommodate a number of different sizes or styles of shoe, the gauge 14 is readily removable by undoing the screw 16 and can be replaced by a selected gauge of different size.

A slot 18 in the rearward side of the block 8 extends throughout the height of the block, the upper end of the slot 18 being bridged by the gauge 14 and the lower end thereof communicating with the interior of the column 4. Two oppositely facing slots 20 are formed one in each of the side walls of the slot 18. The slots 20 are inclined forwardly and together form an inclined staple guide in which a staple can be located to be driven into the heel seat and heel of a shoe on the support so that the staple enters the heel seat and heel with its legs inclined and directed towards a central region of the heel.

A staple driving head 22 is located in the slot 18 and has projections which fit in the slots 20 so that the head 22 can slide in the staple guide formed by the slots 20. The head 22 is pivotally connected to a composite driving link 24 therefor which, when moved upwardly, causes the head 22 to move up the staple guide to drive a staple located in the guide. The link 24 is extensible by means of a screw 26 whereby the head 22 in the guide may be adjusted to take account of various different staple lengths as determined to be suitable for different heels. A return spring 28 acts between the link 24 and the block 8 to which it is secured by means of a screw 30. The spring 28 serves to ensure that the head 22 returns between operating strokes thereof to its rest position (shown in FIG. 2) in which a staple may be located in the guide above the head 22. The lower end of the link 24 is received within the support column 4.

A generally cylindrical driving member 32 is movable vertically within the column 4. The driving member 32 has as many as six cylindrical nail drivers 34 extending upwardly therefrom, the lower ends of the drivers 34 being anchored in the member 32. Each of the drivers 34 is received in one of six vertical cylindrical bores 36 (FIG. 1) which pass through the block 8. These bores 36 are preferably arranged in two rows of three; one row on each side of the center line of the block 8. The bores 36 are positioned over central and forward regions of the support and each forms a nail guide in which a nail can be located to be driven into a heel seat and heel of a shoe. The bores 36 can, if desired, be arranged in other patterns to suit the particular purpose for which the support is required. The upper ends of the four forwardmost of the bores 36 communicate with cylindrical recesses 38 (FIG. 1) in the upper surface of the block 8 in which washers may be located to be inserted into the heel seat of a shoe with the nails from those nail guides.

A cylindrical bore 40 is formed in the upper surface of the driving member 32 and the lower end of the link 24 is received in this recess. The bore 40 communicates with a slot the bottom surface 42 of which serves as a bearing surface which, when the driving member 32 is moved upwardly within the column 4 forces the link 24 upwardly so that the head 22 is caused to move up the staple guide and perform a driving stroke. A guiding member 44 is secured by screws 46 to the upper surface of the driving member 32 fitted between the rows of drivers 34. The guiding member 44 has a cylindrical bore 48 therethrough which communicates with the recess 40. The link 24 passes through the bore 48, the walls of which serve to guide the link 24 when the driving member 32 moves upwardly until the surface 42 engages the end of the link 24. The driving member 32 is fixedly mounted on the upper end of a plunger 50 which extends downwardly through the column 4 and, when the illustrative support is positioned in a machine for attaching heels to shoes, is preferably connected to the piston of a hydraulic cylinder (not shown) thereby constituting a power means which serves to operate the driving member 32. The hydraulic cylinder is thus arranged to cause the driving member 32, the drivers 34, and the head 22 to drive nails and a staple. The driving member 32, the drivers 34 and the head 22 together form driving means of the illustrative support arranged to drive nails and a staple located in the respective guides into a heel seat of a shoe and the heel thereof to attach the heel to the shoe. The staple guide is positioned rearwardly of the nail guides so that a staple therefrom enters a rearward portion of the heel.

In the operation of a heel attaching machine in which the illustrative shoe support is positioned, a staple is located in the staple guide formed by the slots 20 with one leg of the staple in each of the slots 20, nails are located in such of the nail guides formed by the bores 36 as is desired, and, if desired, washers are located in the recesses 38. The location or loading of the staple, nails and washers may be manual or automatic. After this location, a shoe to which a heel is to be attached is located on the support, by means of the gauge 14, with its heel seat over the upper ends of the staple and nail guides. The heel end of the upper of the shoe is positioned around the gauge 14 and the gauge 14 rests against the insole of the shoe. The heel is positioned opposite the gauge 14 on the other side of the insole. The heel attaching machine is then operated clamping the shoe and its heel (by conventional means not herein shown) against movement, with the heel in position against the heel seat to be attached. The hydraulic cylinder of the heel attaching machine is next operated to move the driving member 32 upwardly in the column 4. The upward movement of the member 32 causes the drivers 34 to move up the bores 36 driving the nails located therein into the heel seat and heel of the shoe. At the same time, the surface 42 forces the link 24 upwardly causing the head 22 to move up the staple guide driving the staple located therein into the heel seat and heel of the shoe. The inclination of the staple guide causes the staple to enter the heel with its legs inclined towards a central region of the heel.

It is found that by use of the illustrative shoe support a stiletto type heel can be effectively attached to a shoe in a single operation by means of nails over central and forward portions thereof and by means of a staple at the rearward portion thereof.

Having thus described my invention, what I claim as new and desire to secure by Letters Patent of the United States is:

1. A shoe support for use in a machine for attaching sharply tapering heels to shoes comprising, in combination, a member having a plurality of nail guides in each of which a nail can be located to be driven into forward portions of the heel seat and heel of a shoe, a gauge means mounted on the member for locating the heel seat of the shoe thereon, a staple guide formed in the member and disposed rearwardly thereof so that a staple can be located to be driven forwardly into the tapered rearward portion of the heel seat and heel of the shoe, said staple guide being positioned rearwardly of the nail guides and inclined relative thereto to direct legs of the staple in said staple guide toward a central region of the heel being attached, and driving means including a portion aligned with the nail and staple guides, respectively, to drive the nails and the staple in said guides.

* * * * *